US006901913B1

(12) United States Patent
Tsuchiya et al.

(10) Patent No.: US 6,901,913 B1
(45) Date of Patent: Jun. 7, 2005

(54) FUEL PRESSURE PULSATION SUPPRESSING SYSTEM

(75) Inventors: Hikari Tsuchiya, Gotenba (JP); Tetsuo Ogata, Shizuoka (JP); Kazuteru Mizuno, Numazu (JP); Kazunori Takikawa, Numazu (JP); Yoshiyuki Serizawa, Mishima (JP); Izumi Imura, Shizuoka (JP); Hiroyuki Nishizawa, Numazu (JP)

(73) Assignee: Usui Kokusai Sangyo Kaisha Ltd., Shizuoka (JP)

( * ) Notice: Subject to any disclaimer, the term of this patent is extended or adjusted under 35 U.S.C. 154(b) by 0 days.

(21) Appl. No.: 10/483,779

(22) PCT Filed: Jul. 15, 2002

(86) PCT No.: PCT/JP02/07140

§ 371 (c)(1),
(2), (4) Date: May 4, 2004

(87) PCT Pub. No.: WO03/008796

PCT Pub. Date: Jan. 30, 2003

(30) Foreign Application Priority Data

Jul. 16, 2001 (JP) ..... 2001-214956

(51) Int. Cl.[7] ..... F02M 55/02
(52) U.S. Cl. ..... 123/456; 123/467
(58) Field of Search ..... 123/456, 467, 123/468, 469; 138/26, 28, 30

(56) References Cited

U.S. PATENT DOCUMENTS 4,649,884 A * 3/1987 Tuckey ..... 123/457
4,660,524 A * 4/1987 Bertsch et al. ..... 123/468
5,511,528 A * 4/1996 Iwanaga et al. ..... 123/467
5,575,262 A * 11/1996 Rohde ..... 123/467
5,617,827 A * 4/1997 Eshleman et al. ..... 123/456
5,752,486 A * 5/1998 Nakashima et al. ..... 123/467
6,354,273 B1 * 3/2002 Imura et al. ..... 123/467
6,401,691 B1 * 6/2002 Kawano et al. ..... 123/456
6,463,909 B2 * 10/2002 Asada et al. ..... 123/456
6,505,608 B2 * 1/2003 Hiraku et al. ..... 123/458
6,615,800 B1 * 9/2003 Frank et al. ..... 123/456

FOREIGN PATENT DOCUMENTS

| | | |
|---|---|---|
| EP | 785357 | 7/1997 |
| EP | 995902 | 4/2000 |
| GB | 2346931 | 8/2000 |
| JP | 8-68369 | 3/1996 |
| JP | 8-144889 | 6/1996 |
| JP | 8-246984 | 9/1996 |
| JP | 8-326622 | 12/1996 |
| JP | 11-2164 | 1/1999 |
| JP | 2000-73907 | 3/2000 |
| JP | 2000-320423 | 11/2000 |
| JP | 2000-329030 | 11/2000 |

* cited by examiner

*Primary Examiner*—Weilun Lo
(74) *Attorney, Agent, or Firm*—Wenderoth, Lind & Ponack, L.L.P.

(57) ABSTRACT

A fuel pressure pulsation suppressing system of a fuel piping system for a gasoline engine having a plurality of cylinders disposed in a straight, V-shape or horizontal opposed shape with delivery pipes for distributing fuel to the cylinders of return-less type without a return circuit to a fuel tank, wherein the cross section of at least one of communication pipes forming the delivery pipes forms a flexible absorbing face, an orifice portion for damping pressure pulse wave caused by fuel injection is installed near a connection part between at least one delivery pipe and a supply pipe or a connection pipe, and the cross sectional area of the flow passage of the orifice should desirably be 0.2 times the sectional area of the flow passage of the connection pipe or the supply pipe or below.

5 Claims, 6 Drawing Sheets

FUEL PRESSURE PULSATION SUPPRESSING SYSTEM

TECHNICAL FIELD

The invention relates to a fuel distribution system for a gasoline engine having a plurality of cylinders disposed in a straight, V-shape or horizontal opposed shape. In this type engine, such as V-6 or horizontal opposed six cylinders shape, to each three cylinders of right and left, one delivery pipe for distributing fuel is arranged, whereby on right and left sides of the engine a pair of delivery pipes are arranged. Further in detail, the invention relates to an improvement of a fuel distribution system for a gasoline engine having return-less type delivery pipes without a return circuit to a fuel tank from each delivery pipe.

BACKGROUND TECHNIQUE

Fuel delivery pipes are widely used in an electronic fuel injection system for a gasoline engine. There are two types; one is a return type having a return pipe in which fuel is delivered from a conduit having a fuel passage therein to fuel injectors via cylindrical sockets and then goes back to a fuel tank, and another is a non-return (return-less) type. Recently, for reducing vaporized gas caused by high temperature return fuel and for economical reasons, use of the non-return type is increasing and new problems are arising therefrom, those are, due to reflecting waves (shock waves) which are caused by reciprocal movements of valve operating spools for moving fuel injectors and due to fuel injection pressure pulsations, the fuel delivery pipes and their parts are vibrated thereby emitting uncomfortable noise.

Further, in those gasoline engines having a plurality of cylinders disposed in a V-shape or horizontal opposed shape and having a pair of right and left return-less type delivery pipes, injections are alternately done right and left, where at the moment of the valve opening or valve closing a kind of water hammer is produced. At a special engine rotation speed, a kind of standing wave is caused and a resonance is arised, pressure pulsations are increased, and further fuel injection instability and noise are increased. This phenomena are supposed to be a pulsation resonance in which a peculiar frequency of pressure pulsation wave becomes in coincident with a peculiar rotation speed of the engine, wherein the peculiar frequency are produced through overall overlapping process of the reflecting phenomena and passing phenomena caused in each boundary, such as a boundary between the delivery pipe and the fuel supply line.

In a so-called direct injection type engine in which fuel is directly injected into a combustion chamber, a high pressure supply pump is provided, and therefore a pulsation damper is provided so as to absorb the high pressure pulsations, whereby owing to its absorbing performance a resonance is not produced in general. However, in most cases having no pulsation damper, the resonance appears clearly, and the resonance point falls within the actual working rotation area of a gasoline engine. Accordingly, it is desired to eliminate the resonance.

FIG. 12 illustrates an ordinary automobile in which an automobile 11 (gasoline car) having an electronic fuel injection type V-shape engine 10 is provided with a supply line 13 from a fuel tank 12 to the engine 10, and the line 13 is supported on a front panel or beneath a floor panel by a few or ten or so many clips 14. Fuel supplied through the supply line 13 are transferred to the right and left connecting pipes 18, 19 by way of the branch connector 17, and then to the pair of right and left delivery pipes 15, 16 each of which supplies fuel to one side three cylinders. The pair of right and left delivery pipes 15, 16 mounted on the engine supply fuel to injectors but are non-return (return-less) type having no return circuit to a fuel tank.

As shown, in such an internal combustion engine of a V-shape or horizontal opposed shape utilizing a pair of right and left return-less type delivery pipes, due to the differences of elasticity or sectional flow area between delivery pipes and supply pipes or connecting pipes, as mentioned above, at a special engine rotation speed, a kind of standing wave is caused and a resonance is arised, reflection and passing of pressure pulsations in a boundary are increased, and further fuel injection instability and noise are increased, whereby a problem that uncomfortable noise is transmitted to a driver is arised.

Japanese Patent unexamined publication Hei 11-6438 190261 entitled "Delivery pipe" suggests a method for eliminating an engine stop due to fuel pressure pulsations during idling rotation taking the fuel pressure pulsations and resonance rotation into account.

Although the previously mentioned pulsation damper is utilized in direct injection type engines and some ordinary fuel injection (multi point injection: MPI) type engines, it is not easy to adopt the damper due to space requirements and economical reasons.

Japanese Patent unexamined publication No. 2000-329031 entitled "Fuel delivery pipe" suggests to provide a flexible absorbing surface on an outside wall of the conduit of the delivery pipe so as to suppress pressure pulsations.

Japanese Patent unexamined publication Sho 60-240867 entitled "Fuel supply conduit for fuel injection device of an internal combustion engine" relates to an improvement of a fuel delivery pipe wherein at least one wall of the fuel supply conduit is comprised of an elastic member for damping the fuel pulsations.

Similarly, in Japanese Patent unexamined publication Hei 8-326622 entitled "Fuel pressure pulsation damping device" and Japanese Patent unexamined publication Hei 11-37380 entitled "Delivery pipe", improvements of fuel delivery pipe so as to suppress the pulsation are described.

It is an object of the invention to provide a pressure pulsation suppressing system of a fuel piping which is arranged to an MPI type gasoline engine having a plurality of cylinders disposed in a straight, V-shape or horizontal opposed shape with one or a pair of right and left return-less type delivery pipes each having no return circuit to a fuel tank.

DISCLOSURE OF THE INVENTION

The invention provides, in the first embodiment, a pressure pulsation suppressing system of a fuel piping which is arranged to an MPI type gasoline engine having a plurality of cylinders disposed in a V-shape or horizontal opposed shape with a pair of right and left delivery pipes for distributing fuel to each cylinder, said right and left delivery pipes being connected by a connecting pipe, a fuel pump being accommodated within a fuel tank, said fuel pump and delivery pipe being connected by a supply pipe, and each delivery pipe being a return-less type having no return circuit to said fuel tank.

The invention is, in above system, characterized in that at least one section of a conduit (communication pipe) which constitutes said delivery pipe forms a flexible absorbing surface (face), and an orifice portion for damping pressure pulse wave caused by fuel injection is installed near a connection part between at least one delivery pipe and said supply pipe or said connecting pipe.

As a result of an adoption of said construction, pulsations are damped during the pressure pulsations pass through a narrow gap of the orifice thereby causing complex interference of reflecting waves, whereby generation of vibration is suppressed. If the orifice portion is arranged onto the absorbing surface, the pulsation suppressing effects are enhanced by accompanying with the vibration absorbing effects of the deflection of the absorbing surface.

The invention provides, in the second embodiment, a pressure pulsation suppressing system of a fuel piping which is arranged to an MPI type gasoline engine having a plurality of cylinders disposed in a straight shape with a delivery pipe for distributing fuel to each cylinder, a fuel pump being accommodated within a fuel tank, said fuel pump and delivery pipe being connected by a supply pipe, and each delivery pipe being a return-less type having no return circuit to said fuel tank.

This system is characterized in that at least one section of a conduit (communication pipe) which constitutes said delivery pipe forms a flexible absorbing surface (face), and an orifice portion for damping pressure pulse wave caused by fuel injection is installed near a connection part between said delivery pipe and said supply pipe.

Therefore, the invention can be applied to any of the types in which a plurality of cylinders are arranged in a straight, a V-shape or horizontal opposed shape.

Also in this system, if the orifice portion is arranged on the absorbing surface, the pulsation suppressing effects are enhanced by accompanying with the vibration absorbing effects of the deflection of the absorbing surface.

In this invention, the position and the number of the orifice are defined by experiments or analysis such that, especially while the engine is idling, the vibrations and pressure pulsations are minimized. Since the invention is directed to an insertion of an orifice into the passage of a fuel supply piping, it is applicable to existing automobiles.

BEST MODE FOR UTILIZING THE INVENTION

Other features and advantages of the invention will become apparent from the following descriptions referring to the embodiments of the attached drawings.

Figure 1:
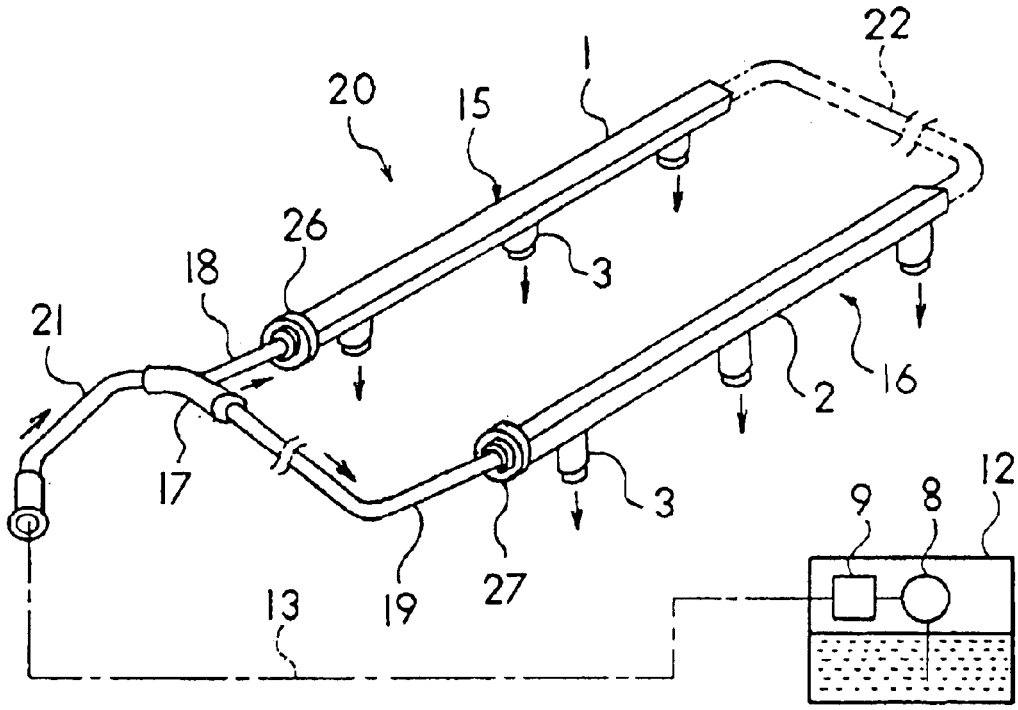
FIG. 1 is a perspective view showing an overall pulsation suppressing system according to the first embodiment of the invention.
Figure 2:
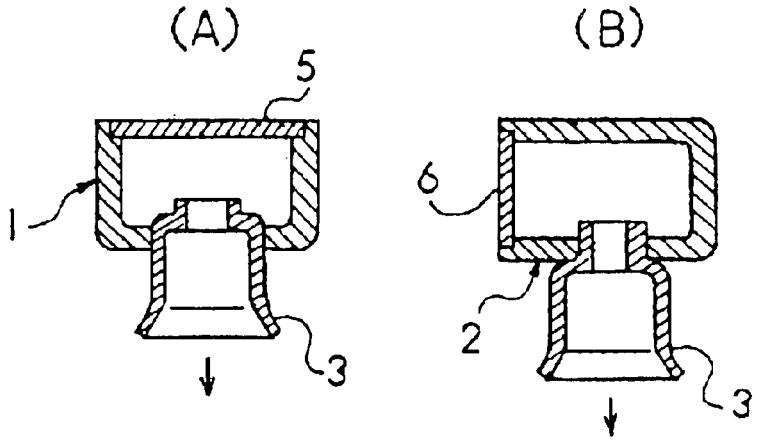
FIG. 2 is an outline sectional view showing an absorbing surface installed on the conduit.

FIG. 1 shows an overall pressure pulsation suppressing system 20 for a fuel piping system according to the first embodiment of the invention, and FIG. 2 shows a construction of an absorbing surface. The engine shown in FIG. 1 is an MPI type gasoline engine having six cylinders disposed in a V-shape or horizontal opposed shape with a pair of right and left delivery pipes 15, 16 for distributing fuel to each cylinder, and the right and left delivery pipes are connected by connecting pipes 18, 19. In the fuel tank 12, as widely known, a fuel pump 8 and a pressure regulator 9 are accommodated, and the fuel pump and delivery pipe are connected by a supply pipe 13. Each of the delivery pipes 15, 16 is a return-less type having no return circuit to the fuel tank 12.

Fuel is supplied from the introducing pipe 21 which constitutes a part of the supply line 13 and then transferred to the right and left connecting pipes 18, 19 by way of the branch connector 17, and then introduced into the right and left conduits 1, 2 which extend along the longitudinal direction. From the sockets 3 which are provided with the right and left conduits 1, 2, fuel is supplied toward fuel injectors (not shown) along the direction of the arrow.

In addition, it is possible to connect each rear end of the conduits 1, 2 by a connecting pipe 22 thereby forming a loop shape of the delivery pipe. Since the right and left injectors works alternately, the connecting pipe 22 gives no influence upon the fuel injection. Connecting lines and pipes are made by plastic or metallic materials.

Based upon the charasteristics of the invention, as shown in FIG. 2, a part of the box-shape section of the conduits 1, 2 which constitutes the delivery pipes 15, 16 is formed into a flexible absorbing surface which can absorb vibration. In FIG. 2A, the upper surface 5 opposing to the socket 3 which is connected to a fuel injector is made by a thin plate thereby providing the absorbing surface. In FIG. 2B, the side surface 6 is made by a thin plate thereby providing the absorbing surface.

In FIG. 1, near the connections between the connecting pipes 18, 19 located at the fuel inlet sides of the corresponding delivery pipes 15, 16 and the pipes 15, 16, orifice portions 26, 27 for damping pressure pulse wave caused by fuel injection are provided. The constructions of the orifice portions 26, 27 are described below.

Figure 3:
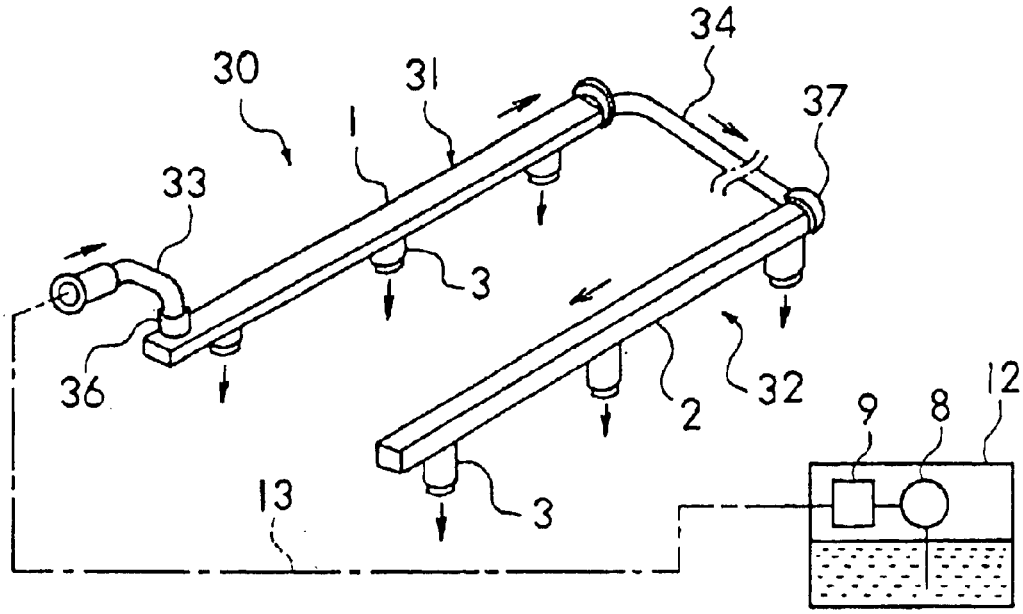
FIG. 3 is a perspective view showing an overall pulsation suppressing system according to another example.

FIG. 3 shows an overall pressure pulsation suppressing system 30 for fuel piping system according to another embodiment of the invention. The engine shown in FIG. 3 is an MPI type gasoline engine having six cylinders disposed in a V-shape or horizontal opposed shape with a pair of right and left delivery pipes 31, 32 for distributing fuel to each cylinder, and the right and left delivery pipes are connected by connecting pipes 34. Each of the delivery pipes 31, 32 is a return-less type having no return circuit to the fuel tank.

Fuel is supplied from the introducing pipe 33 which constitutes a part of the supply line 13 to the left conduit 1, and then the fuel leaving the conduit 1 is transferred to the right conduit 2 by way of the connecting pipe 34. From the sockets 3 which are attached to the right and left conduits 1, 2, fuel is supplied toward fuel injectors (not shown) along the direction of the arrow.

Based upon the charasteristics of the invention, similarly as shown in FIG. 2, a part of the box-shape section of the conduits 1, 2 which constitutes the delivery pipes 31, 32 is formed into a flexible absorbing surface which can absorb vibration.

In addition, near the connection between the delivery pipe 31 and the supply pipe 13 and near the connection between the delivery pipe 32 and the connecting pipe 34, orifice portions 36, 37 for damping pressure pulse wave caused by fuel injection are provided. The constructions of the orifice portions 36, 37 are described below.

Figure 4:
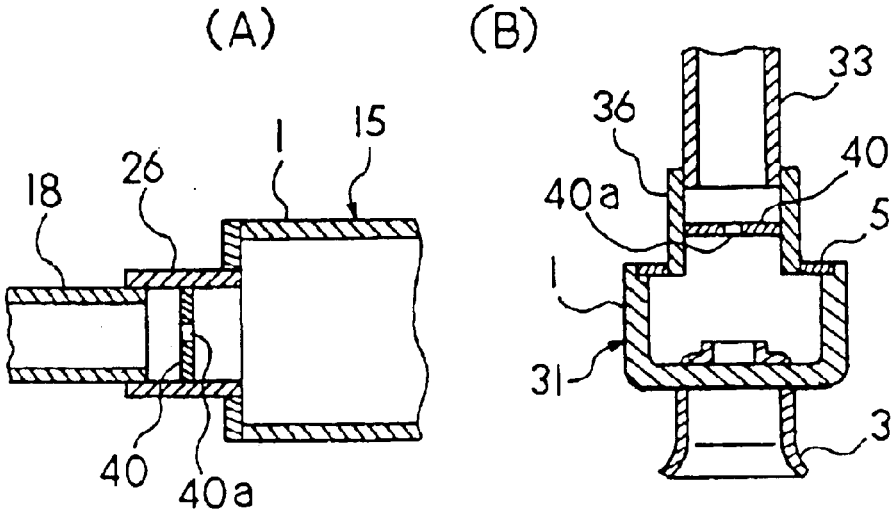
FIG. 4 is a vertical sectional view showing the connecting construction between the orifice and the conduit.

FIGS. 4A, 4B show the outlines of the connecting construction between the orifice and the conduit. FIG. 4A shows a detail of the orifice portion 26 in FIG. 1, wherein the inside of the tubular portion is separated by an orifice plate 40. At the center of the orifice plate 40, a small orifice or aperture 40*a* is drilled. The inside diameter of the aperture 40*a* can be optimized by an experiment.

FIG. 4B shows a detail of the orifice portion 36 in FIG. 3, wherein the inside of the tubular portion is separated by an orifice plate 40. At the center of the orifice plate 40, a small aperture 40*a* is drilled. The inside diameter of the aperture 40*a* can be optimized by an experiment. In this example, one wall of the conduits 1 which constitutes the delivery pipes 31 is formed into a flexible absorbing surface 5. Since the orifice portion 36 is connected to the absorbing surface 5, vibration suppressing effects are enhanced.

Figure 5:
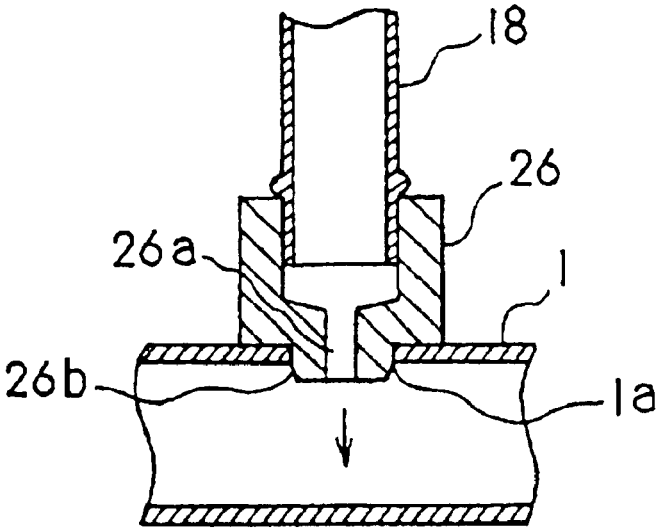
FIG. 5 is a vertical sectional view showing the connecting construction between the orifice and the conduit.

FIG. 5 shows an embodiment for making an experiment of best size of the orifice diameter, wherein an orifice portion 26 is pressed into the front end of the connecting pipe 18, the front end 26*b* of the orifice portion 26 is fixed into an opening la which is drilled onto the conduit 1, whereby fuel passes through the orifice aperture 26*a* into the conduit 1. At the side of the conduit 1, similarly as shown in FIG. 2, a flexible absorbing surface is formed.

The outside diameter of the connecting pipe 18 is 8 mm, the wall thickness is 0.7 mm, the inside diameter is 6.6 mm, the sectional flow area Ac is about 34.2 square mm. The orifice aperture 26*a* is a circle having an inside diameter 3 mm, and its sectional flow area Ao is 7.1 square mm. The sectional flow area ratio Ao:Ac is about 0.2:1.

Figure 6:
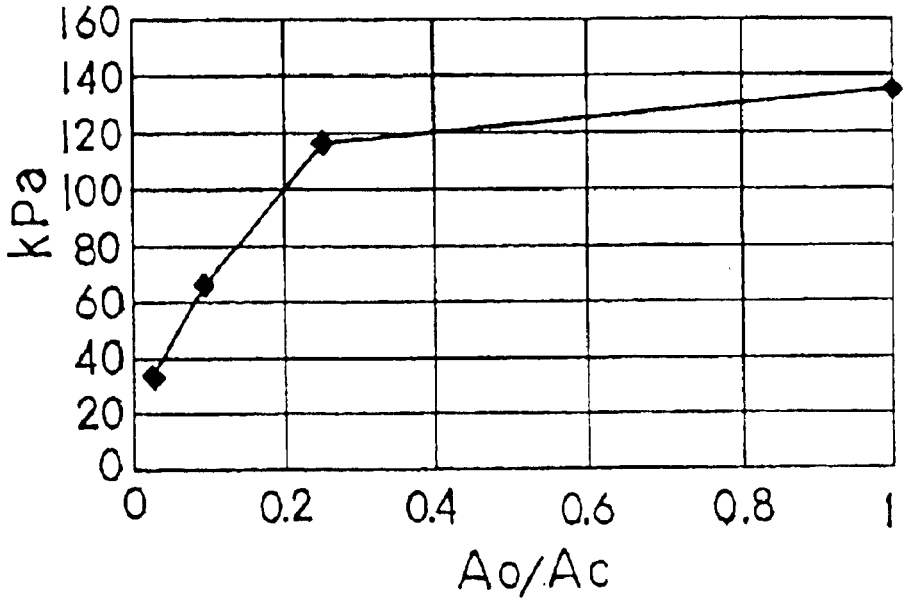
FIG. 6 is a graph showing pressure variations by changing the sectional area of the orifice.

FIG. 6 shows a result of experiment in which pressure variations are tested by changing the inside diameter Ao of the orifice. The horizontal axis shows a rate of Ao/Ac, and the vertical axis shows width of variations of peak pressure under special rotation speed of the engine as the pressure kPa. In this example, when the resonance occurs, the rotation speed was 1500 rpm. As shown in this graph, as the orifice diameter is minimized and the sectional area rate becomes below 1 which corresponds to non-orifice condition, pulsation is damped. Near the point of the rate 0.25, effects appear, and when the rate becomes below 0.2, the effects become great. Accordingly, if the peculiar value of the pressure pulsation wave exists in this piping system, it becomes possible to lower the resonance level below the current level. As a result, quantity of fuel injection does not give bad influence upon the rotation performance of the engine. The standing flow at the point of the connecting pipe gives influence upon the quantity of fuel injection, and if the pressure loss at the orifice becomes great, the standing flow is decreased. However, as far as the minimum flow size of the orifice is kept more than a predetermined value, the standing flow is not badly influenced and also quantity of fuel injection is not badly influenced. Further, it has been confirmed that the ratio of air and fuel is not badly influenced.

Figure 7:
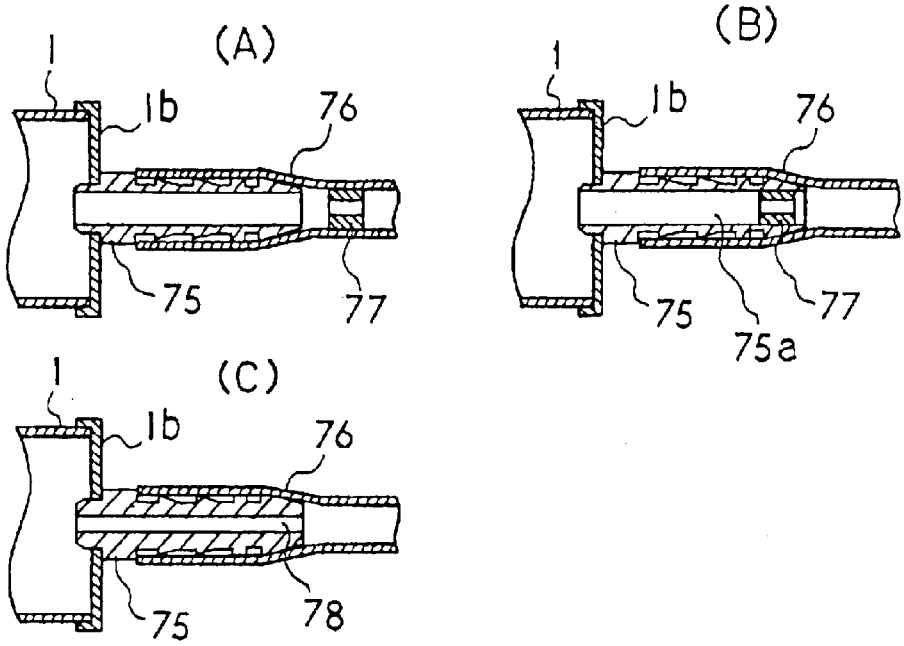
FIG. 7 is a vertical sectional view showing an example of providing an orifice near connecting portion between the conduit and a flexible tube.

FIGS. 7A, 7B, 7C show examples in which the connecting pipes are made by resin materials such as a nylon tube or a rubber hose. In FIG. 7A, into the end plate 1*b* of the conduit 1, a connector 75 is inserted, and an orifice portion 77 is inserted within a parallel portion of a resin tube 76 which is overlapped onto the connector 75. In FIG. 7B, into the central hole 75*a* of the connector 75, an orifice portion 77 is inserted. In FIG. 7C, the central hole 78 of the connector 75 is formed into a slender orifice. In each example, near the connecting portion between the delivery pipe and the connecting pipe, an orifice for damping pressure pulsation wave caused by fuel injection is provided.

Figure 8:
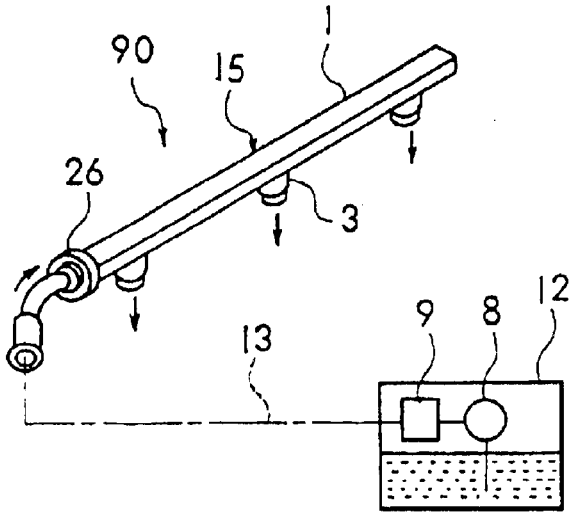
FIG. 8 is a perspective view showing an overall pulsation suppressing system according to the second embodiment of the invention.

FIG. 8 shows a fuel pressure pulsation suppressing system 90 according to the second embodiment of the invention. In this system 90, the gasoline engine has a plurality of cylinders disposed in a straight shape with a delivery pipe 15, a fuel pump 8 is accommodated within a fuel tank 12, and the fuel pump and the delivery pipe are connected by a supply pipe 13. The delivery pipe 15 is a return-less type having no return circuit to the fuel tank.

Based upon the charasteristics of the invention, a flexible absorbing surface is provided with the conduit 1, similarly as shown in FIG. 2. In addition, near the connecting portion between the delivery pipe 15 and the supply pipe 13, an orifice portion 26 for damping pressure pulsation wave caused by fuel injection is provided.

Figure 9:
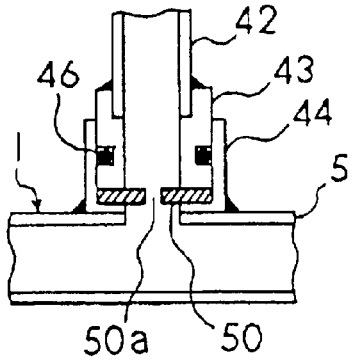
FIG. 9 is an outline sectional view showing a preferable example of the orifice portion.
Figure 10:
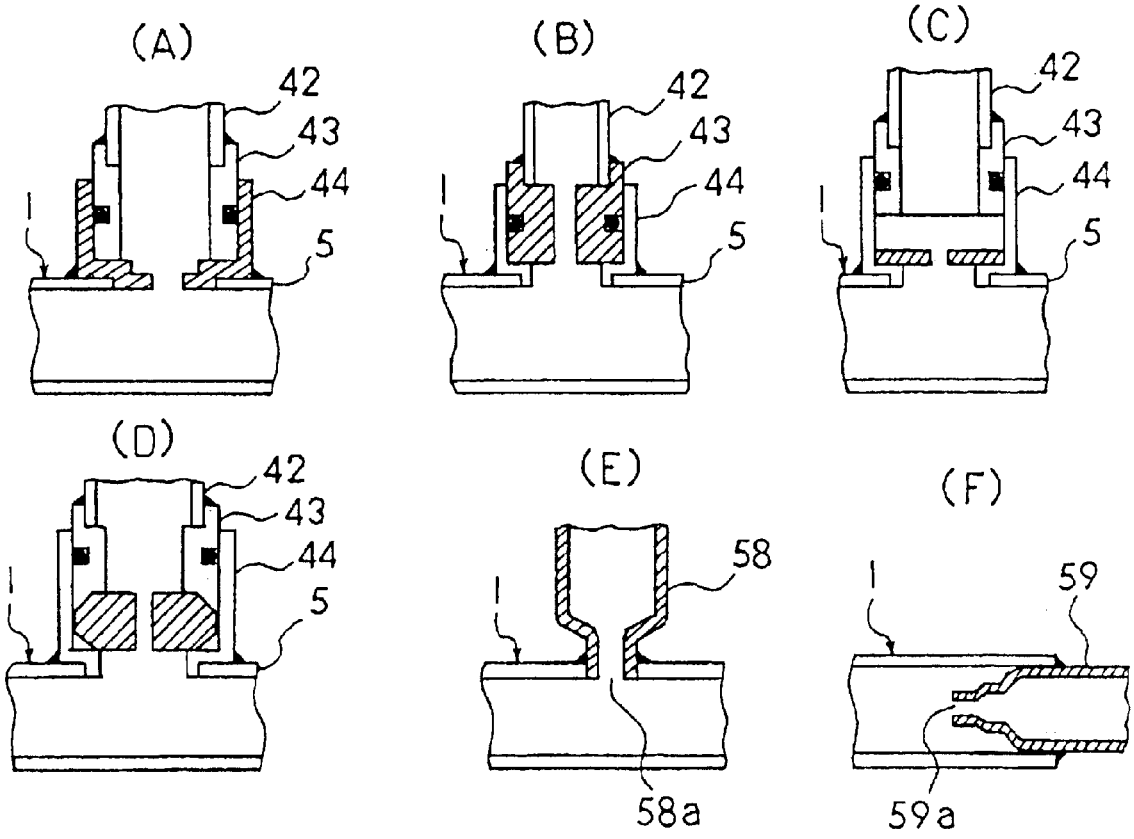
FIG. 10 is an outline sectional view showing a modified example of the orifice portion.
Figure 11:
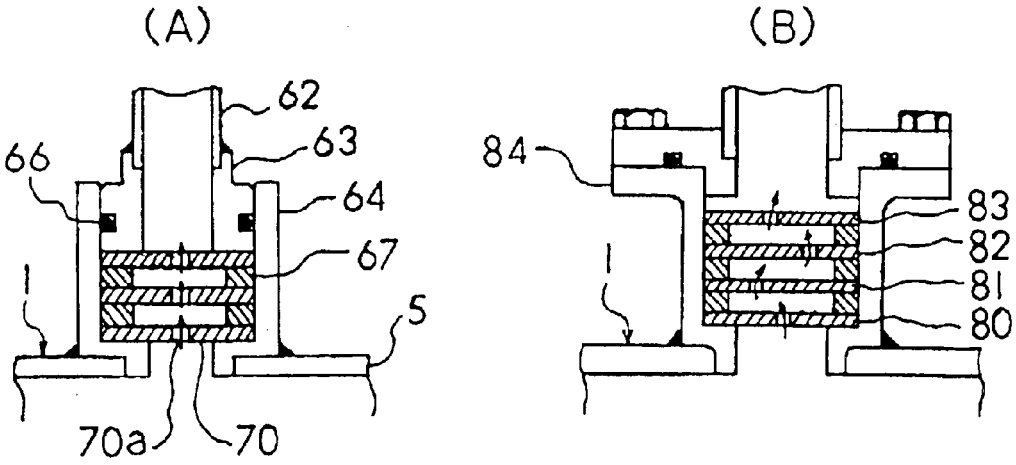
FIG. 11 is an outline sectional view showing a modified example of the orifice portion.
Figure 12:
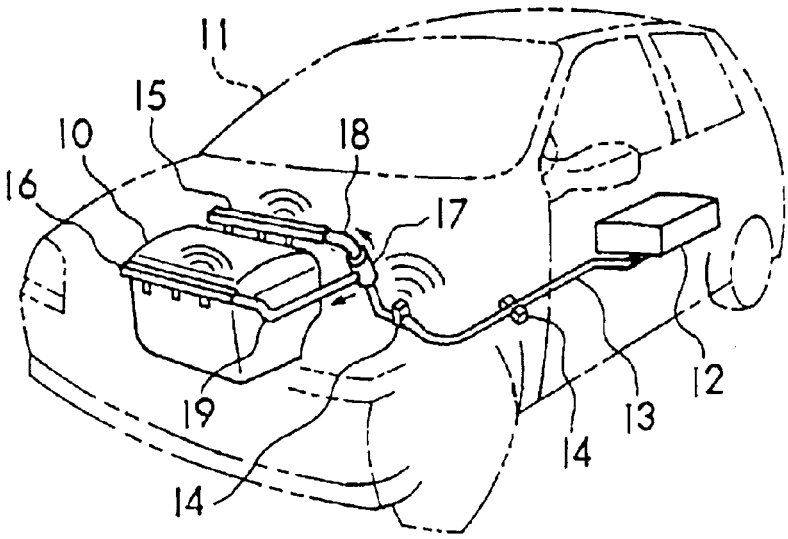
FIG. 12 is a perspective view showing a fuel piping system of an automobile.

FIGS. 9, 10, 11 show examples in which the absorbing surfaces composed of the wall of the delivery pipe are provided with orifice portions. In FIG. 9, to the absorbing surface 5 of the delivery pipe 1, an orifice portion 44 is connected by welding or brazing, and an orifice plate 50 is arranged within the pipe and pressed therein by an adaptor socket 43. Within the adaptor socket 43, an O-ring 46 is inserted for sealing, and to the upper end of the socket, a connecting pipe 42 is connected by press fit, brazing or similar settling means. The inside diameter of the orifice aperture 50*a*, which is centrally drilled in the orifice plate 50, can be optimized by an experiment.

FIGS. 10A, 10B, 10C, 10D show modified examples of the example of FIG. 9. FIG. 10E shows an example wherein the front end of the connecting pipe 58, which is connected to the side of the conduit 1, is swaged or shrinked and formed into an orifice aperture 58*a*. FIG. 10F shows an example wherein the front end of the connecting pipe 59, which is connected to the end of the conduit 1, is swaged or shrinked and formed into an orifice aperture 59*a*. The inside diameter of the small apertures 58*a*, 59*a* can be optimized by an experiment.

FIGS. 11A, 11B show examples in which a plurality of orifice plates are provided. In FIG. 11A, in addition to the orifice portion 64 similar to that of FIG. 9, an adaptor socket 63, a connecting pipe 62, and an O-ring 66, three orifice plates 70 and two adaptor rings 67 are inserted.

In FIG. 11B, four orifice plates 80, 81, 82, 83 are inserted into the orifice portion 84, and the orifice apertures located on each orifice plate are arranged alternately so as to change the phase. Due to the difference of the phase, energy absorption and vibration suppressing effects are enhanced.

As described above in detail, according to the invention, pulsations are damped during the pressure pulsations pass through a narrow gap of the orifice thereby causing complex interference of reflecting waves, whereby generation of vibration is suppressed. Since at least one wall is formed into an absorbing surface composed of a thin plate, if the orifice portion is arranged on the absorbing surface, the pulsation suppressing effects are enhanced by accompanying with the vibration absorbing effects of the deflection of the absorbing surface. The technical effects of the invention are great.

Possibility of Industrial Utilization

The invention can be applied to a fuel distribution system of a gasoline engine having a plurality of cylinders disposed in a straight, v-shape or horizontal opposed shape, especially of return-less type without a return circuit to a fuel tank.

What is claimed is:

1. In a pressure pulsation suppressing system of a fuel piping arranged to a gasoline engine having a plurality of cylinders disposed in a V-shape or horizontal opposed shape with a pair of right and left delivery pipes for distributing fuel to each cylinder, said right and left delivery pipes being connected by a connecting pipe, a fuel pump being accommodated within a fuel tank, said fuel pump and delivery pipe being connected by a supply pipe, and each delivery pipe being a return-less type having no return circuit to said fuel tank, characterized in that:

at least one section of a conduit which constitutes said delivery pipe forms a flexible absorbing surface, and an orifice portion having an orifice for damping pressure pulse wave caused by fuel injection is installed near a connection part between at least one delivery pipe and said supply pipe or said connecting pipe, wherein said orifice portion is installed on said absorbing surface.

2. In a pressure pulsation suppressing system of a fuel piping arranged to a gasoline engine having a plurality of cylinders disposed in a straight shape with a delivery pipe for distributing fuel to each cylinder, a fuel pump being accommodated within a fuel tank, said fuel pump and delivery pipe being connected by a supply pipe, and said delivery pipe being a return-less type having no return circuit to said fuel tank, characterized in that:

at least one section of a conduit which constitutes said delivery pipe forms a flexible absorbing surface, and an orifice portion having an orifice for damping pressure pulse wave caused by fuel injection is installed near a connection part between said delivery pipe and said supply pipe, wherein said orifice portion is installed on said absorbing surface.

3. A pulsation suppressing system as claimed in claim 1, wherein the cross sectional area of the flow passage of said orifice is below 0.2 times the sectional area of the flow passage of the connection pipe.

4. A pulsation suppressing system as claimed in claim 1, wherein the cross sectional area of the flow passage of said orifice is below 0.2 times the sectional area of the flow passage of said supply pipe.

5. A pulsation suppressing system as claimed in claim 2, wherein the cross sectional area of the flow passage of said orifice is below 0.2 times the sectional area of the flow passage of said supply pipe.

* * * * *